US010946236B2

(12) United States Patent
Rudelstorfer

(10) Patent No.: US 10,946,236 B2
(45) Date of Patent: Mar. 16, 2021

(54) OMNIDIRECTIONAL TREADMILL

(71) Applicant: Elmar Rudelstorfer, Vienna (AT)

(72) Inventor: Elmar Rudelstorfer, Vienna (AT)

( * ) Notice: Subject to any disclaimer, the term of this patent is extended or adjusted under 35 U.S.C. 154(b) by 93 days.

(21) Appl. No.: 16/347,696

(22) PCT Filed: Dec. 22, 2017

(86) PCT No.: PCT/AT2017/060344
§ 371 (c)(1),
(2) Date: May 6, 2019

(87) PCT Pub. No.: WO2018/119485
PCT Pub. Date: Jul. 5, 2018

(65) Prior Publication Data

US 2019/0255382 A1 Aug. 22, 2019

(30) Foreign Application Priority Data

Dec. 27, 2016 (AT) ..... 1A A 586/2016

(51) Int. Cl.
*A63B 22/02* (2006.01)
*A63B 69/00* (2006.01)
(Continued)

(52) U.S. Cl.
CPC ..... *A63B 22/0257* (2013.01); *A63B 21/15* (2013.01); *A63B 22/0235* (2013.01);
(Continued)

(58) Field of Classification Search
CPC ... F03G 5/02; F03G 5/025; F03G 5/06; A63B 22/02–0292; A63B 69/0028–0035; A63B 2022/0271
See application file for complete search history.

(56) References Cited

U.S. PATENT DOCUMENTS 5,470,293 A * 11/1995 Schonenberger ..... B65G 23/06 482/54
5,562,572 A * 10/1996 Carmein ..... A61H 3/00 482/4
(Continued)

FOREIGN PATENT DOCUMENTS

CN 103961840 A 8/2014
CN 106178399 A 12/2016
(Continued)

OTHER PUBLICATIONS

Office Action issued in Chinese Patent Application No. 201780071327 dated Jul. 3, 2020 with English translation provided.
(Continued)

*Primary Examiner* — Nyca T Nguyen
(74) *Attorney, Agent, or Firm* — Nixon & Vanderhye

(57) ABSTRACT

Disclosed is an omnidirectional treadmill which has several connected belt units with supporting frames and endless belts which are moved revolving in the first spatial direction. In the second spatial direction, the endless belts of the belt units are moved. The endless belts are driven in the second spatial direction preferably by gear wheels mounted on rolls and by a toothed shaft. The movement of all endless belts is synchronized by coupling with special tooth form crown gears arranged between the belt units.

20 Claims, 7 Drawing Sheets

(51) Int. Cl.
*A63B 21/00* (2006.01)
*A63B 71/06* (2006.01)

(52) U.S. Cl.
CPC ..... *A63B 69/0028* (2013.01); *A63B 22/0285* (2013.01); *A63B 2022/0271* (2013.01); *A63B 2022/0278* (2013.01); *A63B 2071/0638* (2013.01)

(56) References Cited

U.S. PATENT DOCUMENTS

| | | | | |
|---|---|---|---|---|
| 5,846,135 | A | 12/1998 | Hoskins et al. | |
| 6,123,647 | A | 9/2000 | Mitchell | |
| 6,152,854 | A * | 11/2000 | Carmein | A63B 22/025 482/4 |
| 6,348,025 | B1 * | 2/2002 | Schonenberger | A63B 22/02 482/54 |
| 6,854,584 | B2 * | 2/2005 | Henson | B65G 17/345 198/370.02 |
| 7,780,573 | B1 | 8/2010 | Carmein | |
| 8,790,222 | B2 | 7/2014 | Burger | |
| 9,192,810 | B2 | 11/2015 | Beard et al. | |
| 9,409,716 | B2 * | 8/2016 | Bastian, II | B65G 47/2445 |
| 10,377,582 | B2 * | 8/2019 | Lykkegaard | B65G 47/96 |
| 10,464,759 | B2 * | 11/2019 | Lykkegaard | B65G 17/22 |
| 10,603,539 | B2 * | 3/2020 | Moon | A63B 22/0235 |
| 2007/0270285 | A1 * | 11/2007 | Gill | A63B 24/00 482/54 |
| 2010/0022358 | A1 * | 1/2010 | Schwaiger | A63B 22/0242 482/54 |
| 2010/0147430 | A1 * | 6/2010 | Shultz | B60C 7/22 152/450 |
| 2011/0127140 | A1 * | 6/2011 | Brunsen | B65G 47/962 198/348 |
| 2012/0021875 | A1 * | 1/2012 | Karl | A63B 22/0228 482/54 |
| 2014/0011642 | A1 * | 1/2014 | Astilean | A63B 22/02 482/54 |
| 2016/0144225 | A1 * | 5/2016 | Dalebout | A63B 22/0285 482/54 |
| 2016/0199695 | A1 * | 7/2016 | Armstrong | A63B 22/0235 482/8 |
| 2018/0036880 | A1 * | 2/2018 | Stephens, Jr. | B25J 9/161 |

FOREIGN PATENT DOCUMENTS

| | | | | |
|---|---|---|---|---|
| DE | 148695 | | 11/1902 | |
| DE | 861376 | | 12/1952 | |
| DE | 10 2006 040 485 | | 3/2008 | |
| EP | 0 948 377 | | 10/1999 | |
| GB | 2 345 864 | | 7/2000 | |
| JP | 08 280843 | | 10/1996 | |
| WO | WO-9742590 | A1 * | 11/1997 | A63B 22/02 |
| WO | WO9808572 | | 3/1998 | |
| WO | WO-2019051589 | A1 * | 3/2019 | A63B 24/0087 |

OTHER PUBLICATIONS

International Search Report, PCT/AT2017/060344, dated Apr. 3, 2018.
Austrian Search Report, 586/2016, dated Oct. 5, 2017.

* cited by examiner

OMNIDIRECTIONAL TREADMILL

BACKGROUND OF THE INVENTION

Field of the Invention

The invention is directed to a device with a surface movable in two spatial directions, in particular an omnidirectional treadmill.

Description of the Related Art

Conventional treadmills have a surface on which you can move in one spatial direction. The treadmills are used in fitness and home area for jogging. They make it possible to cover distances of any length forwards or backwards without changing location.

For Virtual Reality (VR) applications, the user moves virtually in the application or in the game. Frequently the user wears VR glasses to simulate the game environment, with which the user is visually and audibly shown the game environment and the course of the game. In these VR applications it is necessary that the player can move virtually in any horizontal spatial direction (omnidirectional), for example by walking or running, without changing location, i.e. without significantly changing his spatial position.

It should be noted that this invention is not limited to VR applications and not to horizontal spatial directions alone. However, referring to the preferred field of application, enabling movement in particular walking or running without significantly changing the spatial position of the user in VR applications is subsequently taken in the focus of the illustration.

To enable virtual walking or running in any horizontal spatial direction without significant change of the spatial position, several known designs already exist.

Designs with treadmills are known from the documents below mentioned.

EP 0 948 377 B1 proposes a plurality of solutions for omnidirectional treadmills. The majorities of the solutions require many small parts and provide to the runner tread surfaces with insufficient properties. In the description (0081)-(0085), circulating belt units coupled to one another are described, which form a good running surface and with which the movement of the running surface in the first spatial direction is carried out. For movement in the second spatial direction, endless belts on belt units in the zone of the running surface are moved individually by special friction rollers. Since the movement of the endless belts is indirectly coupled only by friction, there are differences in the movement of adjacent endless belts at higher loads. The endless belts located outside the tread zone are not driven and are coupled only at entry of the tread zone. Load shocks and additional wear occur during the coupling process.

U.S. Pat. No. 6,123,647 A proposes a number of belt units that are moved by a large transversely guided main belt. The discrete belt units are arranged side by side to form a surface. For the movement of the belts on the belt units it is proposed to drive each belt by means of rolls provided with two gear wheels. The gear wheels are driven by a toothed shaft. The disadvantage is that the gear wheels of the belt units are not in contact with the toothed shaft during the curve phase and are brought into sudden engagement with the toothed shaft when a belt unit comes back into contact with the toothed shaft. During the phase of transition shocks occur which lead to delays, noises and subsequently to increased wear. In addition, the individual belt units have no stable supporting frame with a sliding surface, which has a negative effect, because with the belts alone only a poor stable surface is accomplished.

DE 10 2006 040 485 A1 also proposes discrete belt units on a main belt. The discrete belt units are equipped with hydraulic motors and support structures. All hydraulic motors of the belt units are hydraulically connected in series and therefore have the same conveying speed. Disadvantages are the complex and expensive construction with hydraulic motors as well as the rather slow response behavior of a large number of hydraulic elements.

U.S. Pat. No. 7,780,573 B1 proposes discrete belt units which are moved in the first spatial direction by means of chain wheels and chains and which are driven in the second spatial direction by friction via contact elements designed as Omni-wheels. The belt units are connected hinged only at one point to the small pitched chain for the transmission of the movement in the first spatial direction. The second connection to the chain has a displacement possibility and produces thus an asymmetric position of the belt units in the curve. The movement of the belts on the individual belt units is coupled via coupling elements such as constant velocity joints, corrugated pipes or cardan joints. To compensate the change in length of the coupling sliding elements are provided. Corrugated pipes without sliding elements have a short service life. The disadvantage of this invention is that the belt units are only indirectly connected via the chain and not directly to each other, thus the elements of coupling have to be brought elaborately into the required position. For length compensation, additional sliding elements on both sides of a coupling element are required and the sliding elements tend to become jammed, as there is no provision to keep coupling elements at the intersection point of the rotation axes of the rolls.

U.S. Pat. No. 8,790,222 B2 also proposes discrete belt units that are fixed and moved on a main belt. The belt units all have a common, very long endless belt, which is guided by an inclined run on the underside of the belt to the next belt unit. Therefore all conveying surfaces of the belt units have the same conveying speed. The endless belt is driven by friction via ellipsoid rollers. A disadvantage of this design is the long endless belt, which leads in case of rapid speed changes due to inertial forces to local elongation and thus to distortion of the endless belt.

SUMMARY OF THE INVENTION

The object of the invention is to create a device which does not have the aforementioned disadvantages of the known devices.

Pursuant to the invention, this is achieved by a device having the characteristics of claim 1.

Preferential and advantageous embodiments of the invention are the subject of further claims.

Pursuant to the invention, an omnidirectional treadmill is provided, which enables running in any direction of a planar surface.

Individual embodiments of the invention are outlined by the drawings and are described in the following.

BRIEF DESCRIPTION OF THE DRAWINGS

Drawing Description

DESCRIPTION OF THE PREFERRED EMBODIMENTS

Figure 1:
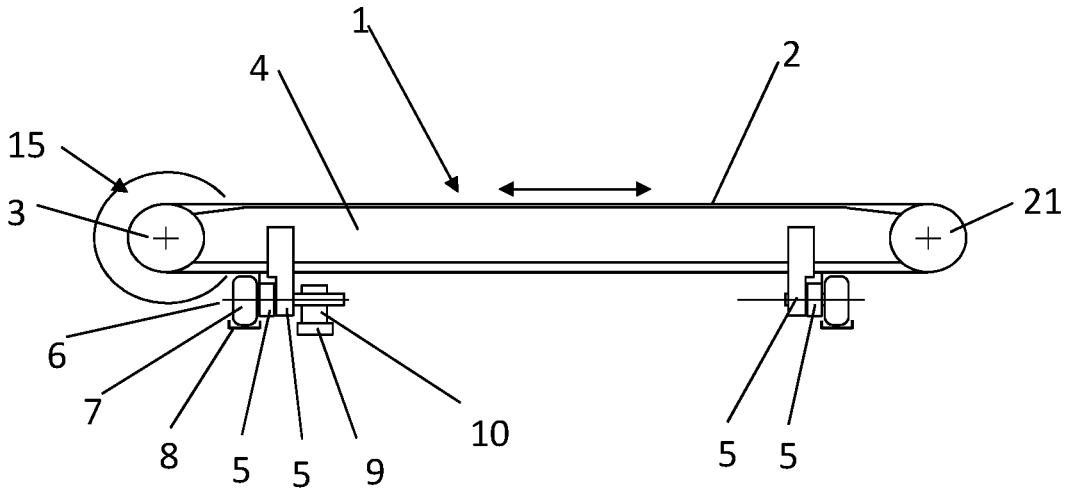
FIG. 1 is a side view of a circulating belt unit in a possible embodiment of the present invention.

FIG. 1 shows in side view a possible embodiment of a belt unit 1 with a continuous endless main belt 2 circulating in the second spatial direction on roll 3 and roll 21. The rolls 3 and 21 are rotatable mounted on a support frame 4 of the belt unit 1. A bracket 5 is attached to the support frame 4. The bracket 5 is swivel-mounted at an axis 6 on to another bracket 5 which is attached to the support frame of the adjacent belt unit 1.

The adjacent belt unit 1 is in turn connected to the following belt unit 1 via a bracket 5 which can be swiveled, and so on, so that all belt units 1 form a continuous chain.

On the same axis 6 which is defined by the connection of adjacent belt units 1 is a roller 7 arranged, which runs on a spatially fixed rail 8.

The rail 8 is provided with semi-circular rails at the ends (FIG. 2) so that a complete circulation of the belt units 1 can be carried out in the first spatial direction.

Figure 2:
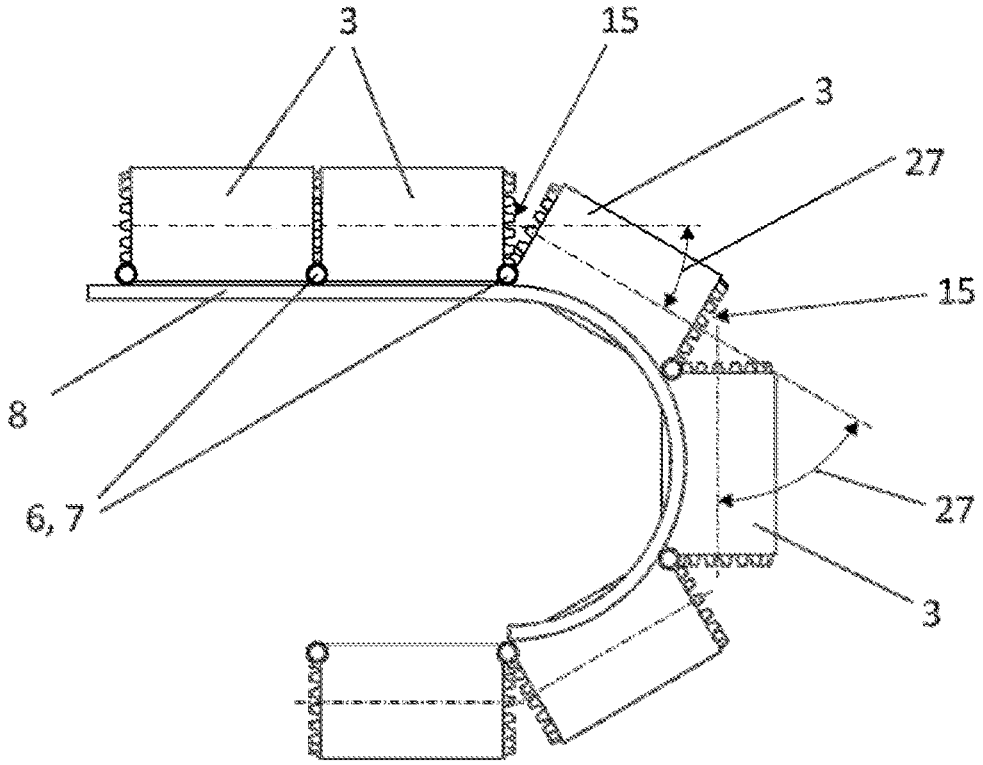
FIG. 2 shows rolls of belt units of an embodiment of the present invention in various positions of the circulation in a side view.

FIG. 2 shows several rolls 3 of belt units 1 in a part of the circulation connected to one another. In circulation, the belt units are guided by rollers 7 on the fixed rail 8. The rotational movement of a roll 3 around its axis is coupled by a crown gear 15 described in the following with the rotational movement of the roll 3 of the adjacent belt unit 1. The angle 27 between the rotation axes of adjacent rolls 3 is changed at center 6 over a wide range. One crown wheel of the crown gear 15 is each fixed to the associated roll 3 and forms a fixed turning unit with the roll 3. The coupling of the rotational movement of adjacent rolls 3 can be done with crown gears by direct contact in vicinity of axis 6 requiring no further elements, such as sliding elements for length compensation.

The axis 6 for angle change 27 of rotation axes of adjacent rolls 3 is formed by the swivel connection. The axis 6 has the same position as the axis of rotation of the roller 7, which runs on the rail 8.

Figure 3:
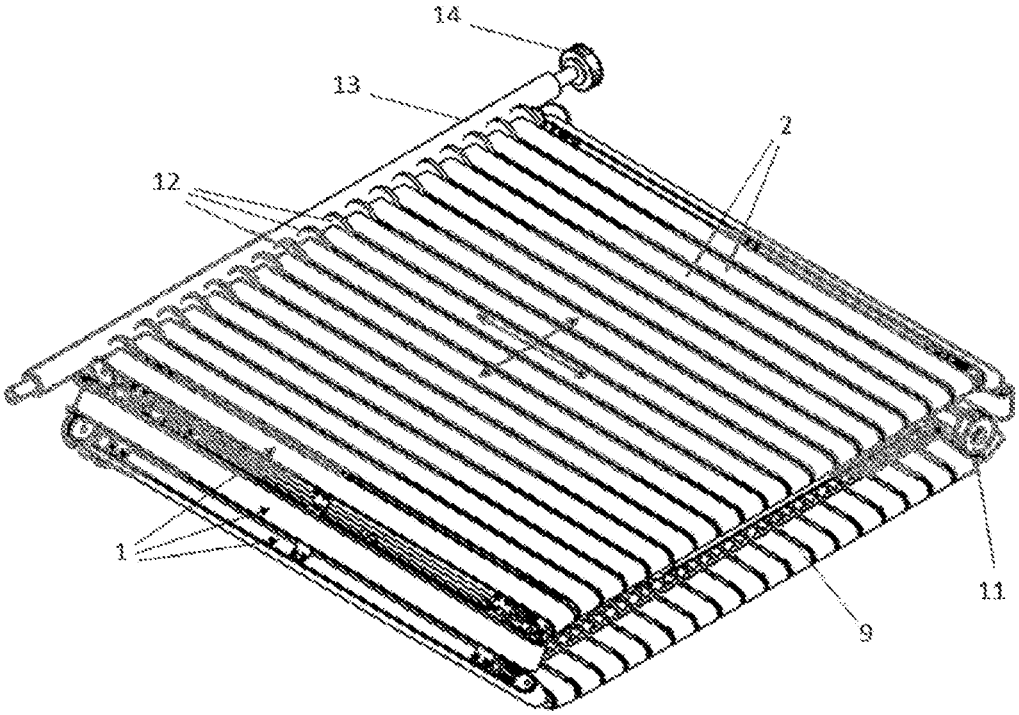
FIG. 3 is a perspective view with the main functions of the device in an embodiment of the present invention.

FIG. 3 shows in a simplified overview the main functions of a device according to the invention. The belt units 1 which are lying in the upper, walkable part are arranged side by side in such a way that the belt units 1 form a level with their endless belts 2. The belt units 1 roll with rollers 7 along fixed rails 8 (FIG. 2), whereby the movement takes place in the first spatial direction. By moving the endless belts 2 of the belt units 1, the movement in the second spatial direction takes place. In the combination of the two main directions of movement (symbolized by the double arrows in FIG. 3) any direction of movement in the plane is executable.

The drive in the first spatial direction is caused by the drive wheel 11, which moves the driving means 9, which in turn moves the belt units 1 in the first spatial direction.

The drive in the second spatial direction in the embodiment shown is by gear wheels 12, each connected to a roll 3 of the belt unit 1. The gear wheels 12 can be driven by a toothed shaft 13 parallel to the first main axis. The toothed shaft 13 can be driven via a drive wheel 14. By rotating the gear wheels 12, the plane formed by the endless belts 2 is moved in the second spatial direction.

Figure 4:
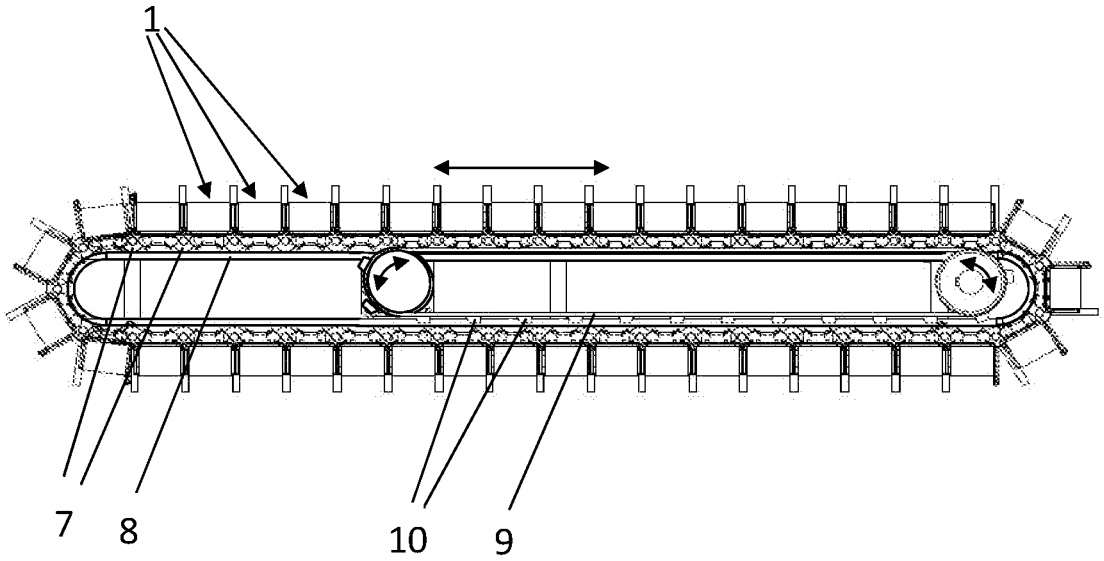
FIG. 4 is a side view of an embodiment of the present invention.

FIG. 4 shows in side view multiple belt units 1, which are located by the rollers 7 on the rail 8 in circulation in the first spatial direction. At the end of the straight rail 8, the belt units 1 are guided by a curved rail and further joined to form an endless chain. It can be seen from the diagram that the distance between the rollers 7, due to the width of a belt unit 1, is large in relation to the radius of the semicircular rail at the end of the straight rail 8. In the curve, a strong polygon effect would occur in case of a drive with a chain wheel. This is avoided in the preferred embodiment by using the endless driving means 9 to drive the first spatial direction. The driving means 9 consists of a flexible belt, preferably designed as a toothed belt. The driving means 9 have its own oval orbit and is equipped with cams 10, which come into contact with the belt units 1 in the straight part of the orbit and effectuate the movement of the belt units 1 in the first spatial direction.

Figure 5:
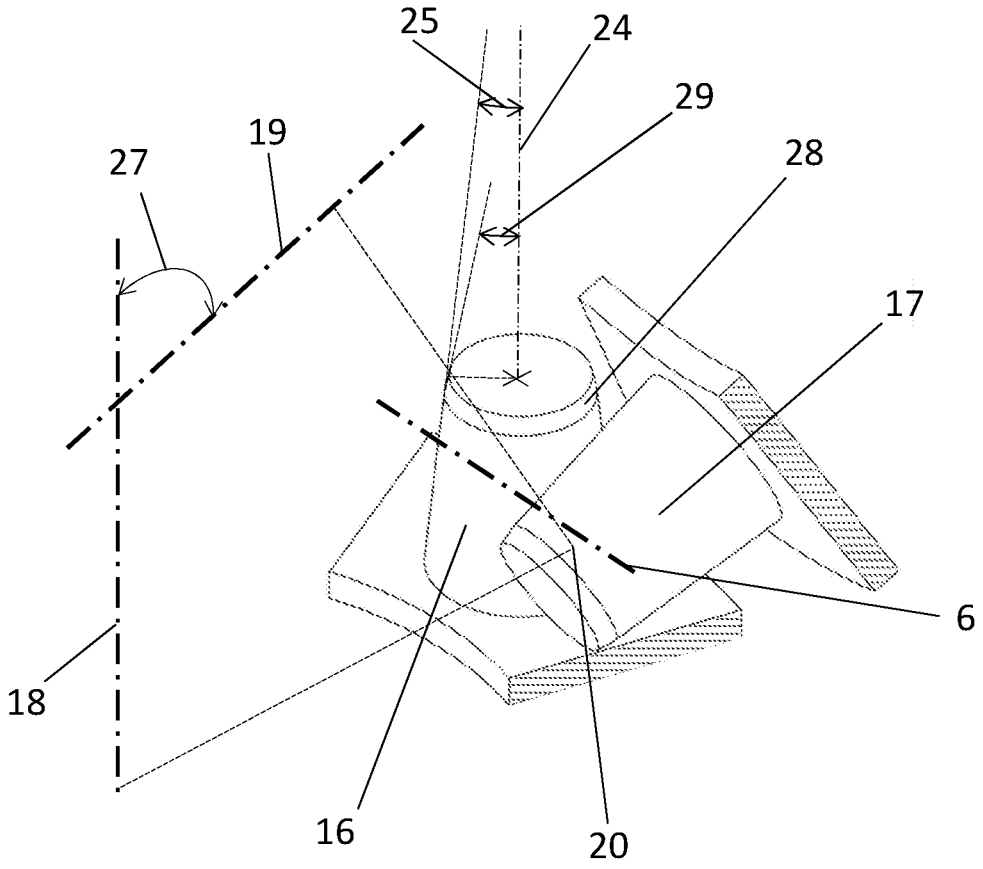
FIG. 5 is a design of teeth of a crown gear of the present invention

FIG. 5 shows in a detail view a design of the teeth of the crown gear of the subject invention.

A crown gear 15 is advantageous for the invention, which transfers the rotational movement of a roll 3 of one belt unit 1 to the roll 3 of the adjacent belt unit 1 under the following conditions:

(i) For a small overall height of the construction, the transfer should take place over a wide angle range 27 of the rotation axes of the rolls 3, for example between 0° and 60°.

(ii) The rotational movement around axis 18 of the driving crown wheel shall be transferred to the driven crown wheel around axis 19 continuously and without noticeable time delay under all operating conditions. This applies in particular to changes in rotational speed and change of direction of rotation.

(iii) The axis 6 of the change of angle 27 of the rotation axes of the rolls 3 should be located far outside the point of intersection of the rotation axes 18 and 19 so that a collision of the belt units at maximum angle 27 is avoided.

Figure 6:
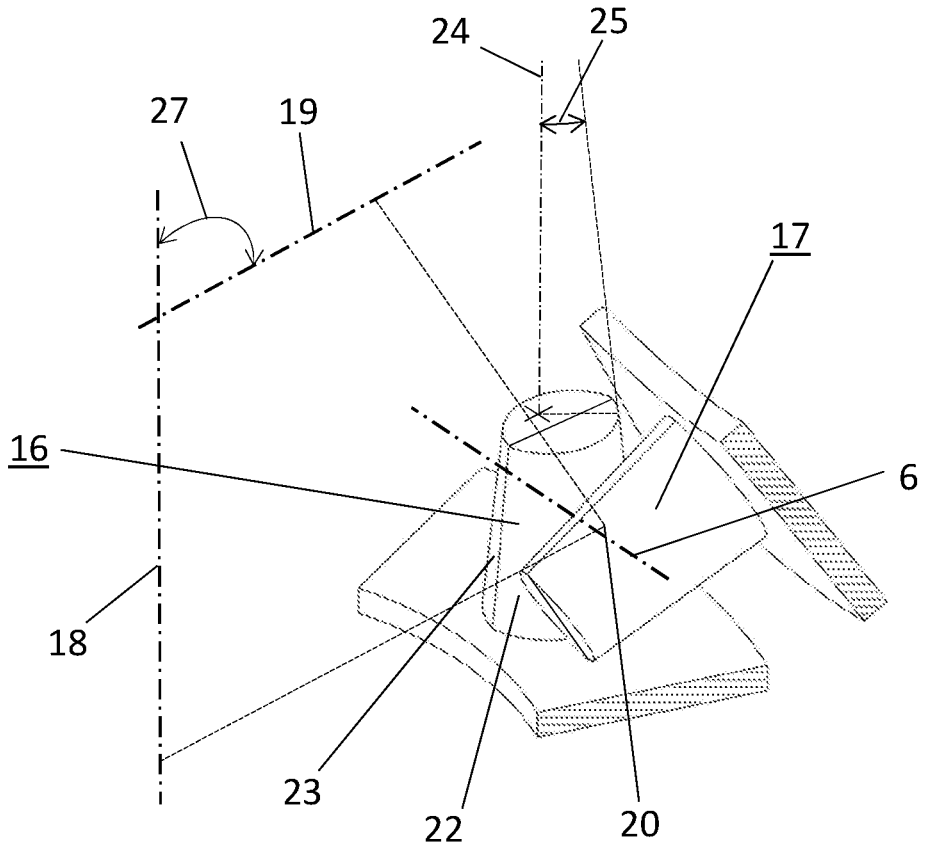
FIG. 6 is another design of teeth of a crown gear of the present invention.

The above conditions for transfer are carried out, according to the invention, by means of a crown gear, of which the crown gear wheels have tooth forms shaped like parts of cones, the driving and the driven crown gear wheel preferably having the same tooth form. A tooth 16, 17 can consist of a complete rotational symmetrical truncated cone (FIG. 5) or of two partial cones (FIG. 6). The partial cone or truncated cone has a cone axis parallel to the rotation axis of the crown wheel. The conical surfaces are preferably created by rotating a generatrix line around the cone axis, so that cuts orthogonal to the cone axis result in circular or circular-segment-shaped cross-sections.

FIG. 5 describes an embodiment of a complete rotational symmetrical truncated cone produced by a straight line generatrix. The cone 16 of the driving wheel touches the cone of the driven wheel at the contact point 20. Using axis 6, the gear wheels with rotation axes 18 and 19 are swiveled to a swivel angle 27. The rotation axis 24 of the cone generating line is parallel to the rotation axis 18 of the driving crown wheel.

The straight line generatrix is inclined at a taper angle 25 to the rotary axis 24. The taper angle is between 8.5° and 13°, preferably between 8.5° and 10.5°. The preferred taper angle range provides particularly favorable solutions to the requirements (i) and (ii), but requires short tooth heights to avoid undercutting. The undercut can be avoided without tooth height reduction by applying a chamfer 28 to the edge of the truncated cone. The second cone generatrix for the chamfer 28 is a straight line with a taper angle 29.

The connection from the cone with taper angle 25 to the cone with taper angle 29 is preferably made by roundness. The thereby resulting rotation body preferentially has an arc as generatrix with taper angles, which progress from first to the second taper angle of the two straight line generatrices.

The length of at least one of the straight line generatrix can be reduced to zero in a possible embodiment whereby only the final angle of the arc is fixed and the chamfer 28 show up as simple rounding.

FIG. 6 shows an example of how two partial cones can be assembled together to form the crown gear wheel teeth 16 and 17. The crown gear wheel tooth 16 consists of a partial cone 22 and a mirror-symmetry arranged partial cone 23. The mirror-symmetry arranged partial cone 23 takes over the drive contact after change of the direction of rotation along rotation axis 18. For the partial cone 22, the cone generating axis 24 and the taper angle 25 are marked. The cone generating axis 24 is parallel to the rotation axis 18 of the driving crown wheel. The surface of the partial cone is generated by rotation of a straight line which has a taper angle 25 to the axis of rotation 24. The same taper angle ranges as described under FIG. 5 for the complete truncated cone also apply for the partial cones under FIG. 6.

Figure 7:
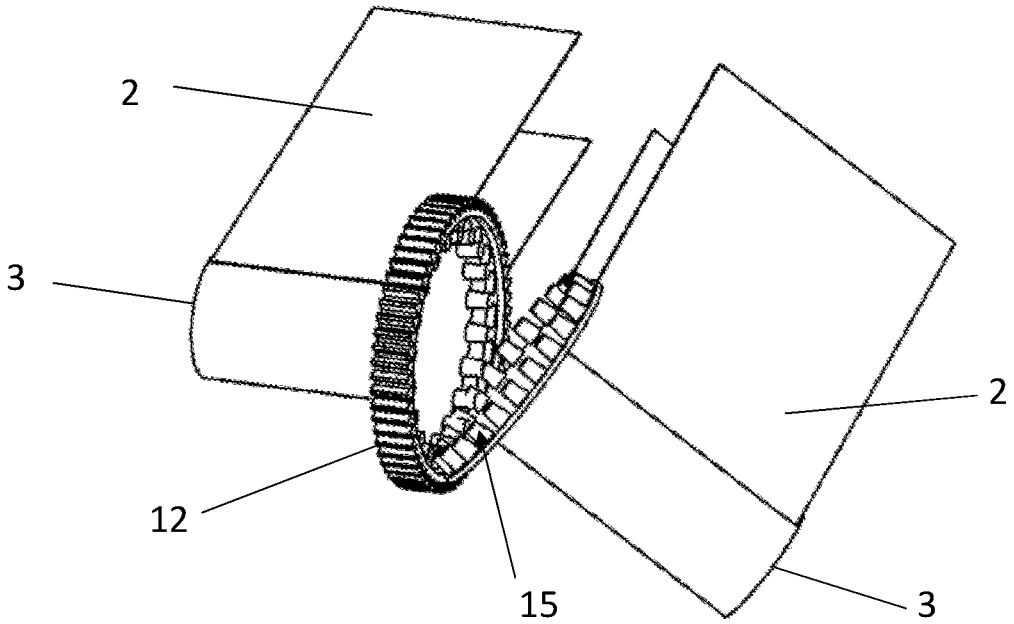
FIG. 7 is a perspective view of a version of a crown gear with integrated drive gear wheel

FIG. 7 shows a preferred embodiment of the crown gear, in which one crown gear wheel of the crown gear 15 is combined with the drive gear 12. When the endless belts 2 of the belt units 1 are located in the straight walkable part of the device, they form a plane surface. The plane surface formed by the endless belts 2 has partly gaps due to the design requirements of arranging crown gear wheels, drive and/or support structures. An advantageous embodiment is the combination of a crown gear within the drive gear 12. Belt units 1, which are located in the upper straight part of the circulation, align their axes of rotation of the rolls 3. As the preferred embodiment the crown gear 15 is completely housed in this position within the drive gear 12. Thereby the design gap between the belts 2 is narrow and only determined by the width of the drive gear 12.

The treadmill according to the invention provides to the runner a plane surface that can be moved in all directions. Between the endless belts 2 of band units 1 narrow surfaces remain in fact, which only take over the movements of the first spatial direction. However, these narrow surfaces do not interfere in the practical operation because they are lower by the thickness of the endless belt and are therefore not reached when the user step on it.

In summary, the invention is directed to an omnidirectional treadmill which has several connected belt units 1 with supporting frames 4 and endless belts 2 which are moved revolving in the first spatial direction. In the second spatial direction, the endless belts 2 of the belt units 1 are moved. The endless belts 2 are driven in the second spatial direction preferably by gear wheels 12 mounted on rolls 3 and by a toothed shaft 13. The movement of all endless belts 2 is synchronized by coupling with special tooth form crown gears 15 arranged between the belt units 1.

The invention claimed is:

1. A device with a surface movable in two spatial directions, the device comprising:

a plurality of belt systems movable in a first one of the spatial directions, each of the belt systems being provided with a supporting frame, each of the supporting frames of a respective one of the belt systems being pivotally-connected with the supporting frame of an adjacent one of the belt systems via one or more axis forming a rotary connection at a fixed distance, each of the belt systems being configured to be driven by at least one drive system, the belt systems being provided for movement in the second spatial direction with a plurality of driving rolls and driven rolls and a plurality of endless belts which are coupled to a drive, rotary movement of one of the driving rolls with an adjacent one of the driven rolls of an adjacent one of the belt systems being coupled by a crown gear with a tooth profile with which variable rotary movements of the driving roll are continuously transmitted to the driven roll when an angle between the axis of rotation of the driving and driven rolls changes, an axis lying in an area of an engagement profile and outside a point of intersection of the axes of rotation of the driving and driven rolls.

2. The device according to claim 1, wherein the crown gear is provided with the tooth profile in the form of a part of a rotary body with an axis of rotation parallel to the axis of rotation of the crown gear and with cross-sections right-angled to the axis of rotation in the form of segments of a circle.

3. The device according to claim 2, wherein the crown gear is furnished with the tooth profile in the form of the rotary body or the part of the rotary body formed by two straight generatrices, of which the first generatrix has a taper angle to the cone axis of between 5° and 13°, and the second generatrix has a taper angle to a cone axis of between 8° and 15°.

4. The device according to claim 3, wherein the crown gear is furnished with the tooth profile in the form of the rotary body.

5. The device according to claim 3, wherein the crown gear is furnished with the tooth profile in the form of the rotary body which is composed of two partial rotary bodies and having axes of rotation aligned parallel to the axis of rotation of the crown gear.

6. The device according to claim 2, wherein the crown gear has a tooth profile in the form of the rotary body or the part of the rotary body formed by two straight generatrices, of which the first generatrix has a taper angle to a cone axis between 8.5 and 10.5°, and the second generatrix has a taper angle to the cone axis of between 8° and 15°, and of which the connection from a first cone to a second cone is made with a round line generatrix to form the central part of the rotary body, whereby the taper angles of the round line have values in the course of the round line between the taper angles of the cones.

7. The device according to claim 2, further comprising a plurality of rollers rotatably connected to the belt systems, the rollers running on rails in the first spatial direction, the axis of rotation of one of the rollers coinciding with the axis of the rotary connection of the one belt system with the adjacent belt system.

8. The device according to claim 1, wherein the crown gear is furnished with the tooth profile in the form of a truncated cone which is optionally composed of two partial truncated cones and having cone axes aligned parallel to the rotation axis of the crown gear.

9. The device according to claim 8, wherein the truncated cones or partial truncated cones are formed by a straight generatrix which has a taper angle to a cone axis of between 8.5° and 13°.

10. The device according to claim 9, further comprising a plurality of rollers rotatably connected to the belt systems, the rollers running on rails in the first spatial direction, the axis of rotation of one of the rollers coinciding with the axis of the rotary connection of the one belt system with the adjacent belt system.

11. The device according to claim 8, further comprising a plurality of rollers rotatably connected to the belt systems, the rollers running on rails in the first spatial direction, the axis of rotation of one of the rollers coinciding with the axis of the rotary connection of the one belt system with the adjacent belt system.

12. The device according to claim 1, wherein the driven rolls are driven by a gear wheel connected to the driven rolls.

13. The device according to claim 12, wherein the crown gear is located partially or completely within the gear wheel at the position of an angle of 0°.

14. The device according to claim 1, wherein the drive in the first spatial direction is by the drive system on which cams are mounted which engage in the first spatial direction with the belt systems and drive the belt systems in the first spatial direction.

15. The device according to claim 14, wherein the drive system comprises at least one driven toothed belt or at least one driven chain on which the cams are mounted.

16. The device according to claim 14, wherein the driving system comprises at least one driven toothed belt or at least one driven fine-linked chain on which the cams are mounted.

17. The device according to claim 1, wherein the crown gear is furnished with a tooth profile in the form of a truncated cone composed of two partial truncated cones and having cone axes aligned parallel to the rotation axis of the crown gear.

18. The device according to claim 17, wherein the truncated cones or partial truncated cones are formed by a straight generatrix which has a taper angle to a cone axis of between 8.5° and 10.5°.

19. The device according to claim 1, further comprising a plurality of rollers rotatably connected to the belt systems, the rollers running on rails in the first spatial direction, the axis of rotation of one of the rollers coinciding with the axis of the rotary connection of the one belt system with the adjacent belt system.

20. The device according to claim 1, wherein the crown gear is connected to a gear wheel which, at the position at an angle of 0°, engages at least one toothed shaft parallel to the first spatial direction.

* * * * *